US005254524A

United States Patent [19]

Guittard et al.

[11] Patent Number: 5,254,524

[45] Date of Patent: Oct. 19, 1993

[54] TEXTURED SURFACE BETWEEN DONOR AND RECEIVER FOR LASER-INDUCED THERMAL DYE TRANSFER

[75] Inventors: Mark P. Guittard; Hugh S. A. Gilmour, both of Rochester, N.Y.

[73] Assignee: Eastman Kodak Company, Rochester, N.Y.

[21] Appl. No.: 800,903

[22] Filed: Nov. 26, 1991

[51] Int. Cl.[5] ..... B41M 5/035; B41M 5/38

[52] U.S. Cl. ..... 503/227; 428/141; 428/195; 428/913; 428/914; 430/200; 430/201; 430/945

[58] Field of Search ..... 8/471; 428/195, 913, 428/914, 141, 409; 430/200, 201, 945; 503/227

[56] References Cited

U.S. PATENT DOCUMENTS

| | | | |
|---|---|---|---|
| 3,706,276 | 12/1972 | Yamada et al. | 101/453 |
| 4,772,582 | 9/1988 | DeBoer | 503/227 |
| 4,774,,224 | 9/1988 | Campbell | 503/227 |
| 4,876,235 | 10/1989 | DeBoer | 503/227 |
| 5,143,904 | 9/1992 | Minato et al. | 503/227 |

FOREIGN PATENT DOCUMENTS

| | | | |
|---|---|---|---|
| 0454428 | 10/1991 | European Pat. Off. | 503/227 |
| 59-085792 | 5/1984 | Japan | 503/227 |

*Primary Examiner*—B. Hamilton Hess
*Attorney, Agent, or Firm*—Harold E. Cole

[57] ABSTRACT

This invention relates to a thermal dye transfer assemblage comprising:

a) a dye-donor element comprising a support having thereon a dye layer comprising a dye dispersed in a polymeric binder and an infrared absorbing material associated therewith, and b) a dye-receiving element comprising a support having thereon a polymeric dye image-receiving layer, the dye-receiving element being in a superposed relationship with the dye-donor element so that the dye layer is adjacent to the dye image-receiving layer, the improvement wherein said polymeric layer of either the dye-donor element or the dye-receiving element in face-to-face relationship therewith has a textured surface which is formed only by said polymer, so that effective contact between the dye-receiving element and the dye-donor element is prevented during transfer of a laser-induced thermal dye transfer image, the textured surface having a surface roughness average, $R_a$, of at least 0.8 $\mu$m.

12 Claims, No Drawings

TEXTURED SURFACE BETWEEN DONOR AND RECEIVER FOR LASER-INDUCED THERMAL DYE TRANSFER

This invention relates to the use of a textured surface between a donor and receiver in a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

Spacer beads may be employed in a separate layer over the dye layer of the dye-donor in the above-described laser process in order to prevent sticking of the dye-donor to the dye-receiver during dye transfer, and also to increase the uniformity and density of the transferred image. That invention is more fully described in U.S. Pat. No. 4,772,582.

Alternatively, the spacer beads may be employed in the receiving layer of the dye-receiver as described in U.S. Pat. No. 4,876,235. The spacer beads may be coated with a polymeric binder if desired. Coating the spacer beads in the receiver is generally preferred because the same set of beads is used as spacers when a color image is printed from multiple dye-donors. With receiver spacer beads, the defects are usually clear or of a background hue but generally are visible to one degree or another in the imaged receiver. A reason for this is that the spacer beads are not receptive to dye and create low-density specks in the image which are particularly noticeable in the maximum density areas. The spacer bead composition may be changed to make the bead more receptive to dye by increasing the porosity or organic solvent solubility of the bead, or by making the bead hollow to decrease its heat capacity. Spacer beads may be made from polymers in which the dyes themselves are soluble or infrared absorbers may be incorporated into the beads to promote diffusion of dye into the beads.

In some instances, spacer beads will cause dark specks in projected images because they act as microscopic lenses. This is minimized by making the spacer beads of a refractive index lower than the receiver polymer. Thus, the part of the bead which protrudes above the polymer acts as a positive lens, and the portion which is buried within the polymer will have the opposite effect and the two lens effects will partly cancel each other. Also, the surface of the coating can be smoothed after imaging. This can be accomplished by calendaring the surface, by coating with a fluid which hardens to a clear film, or by laminating the surface to a transparent sheet. Commercial pressure-sensitive tapes may also be used, but may cause dye smearing. A polymeric laminate for identification badges, preferably with a hydrophilic auxiliary layer, laminated to a beaded imaged receiver produces a rigid transparency suitable for direct projection with minimal bead specks.

As noted above, there is a problem with using spacer beads in the laser dye transfer system described above in that the beads hinder or prevent dye passage to the receiver. The beads also cause shadows to appear in the transferred image.

It would be desirable to provide a way to improve the uniformity of the dye image which is transferred by laser, thereby resulting in improved image uniformity, without causing shading to appear in the transferred image.

These and other objects are achieved in accordance with this invention which relates to a thermal dye transfer assemblage comprising:

a) a dye-donor element comprising a support having thereon a dye layer comprising a dye dispersed in a polymeric binder and an infrared absorbing material associated therewith, and b) a dye-receiving element comprising a support having thereon a polymeric dye image-receiving layer, the dye-receiving element being in a superposed relationship with the dye-donor element so that the dye layer is adjacent to the dye image-receiving layer, the improvement wherein the outer polymeric layer of either the dye-donor element or the dye-receiving element in face-to-face relationship therewith has a textured surface which is formed only by said polymer, so that effective contact between the dye-receiving element and the dye-donor element is prevented during transfer of a laser-induced thermal dye transfer image, the textured surface having a surface roughness average, $R_a$, of at least 0.8 $\mu$m.

The $R_a$ in $\mu$m (arithmetic average of all the height deviations from the mean surface position) (proportional to the cell height) of the textured surface can be evaluated by determining the average surface roughness according to ANSI B46.1.

As noted in the prior art above, dye-donors and dye-receivers for laser dye transfer are known to have spacer beads which may be considered textured. However, such a textured surface is formed by the spacer beads present in the polymer of the outer layer, and not only by the polymer of the outer layer itself as in the present invention.

There are several ways to create a textured surface on the outer layer of the dye-donor or dye-receiver. There may be used techniques such as casting, solvent embossing, setting of a crystallizable melt, embossing with a roller having a matte surface, or forming a convective cell. In a preferred embodiment of the invention, embossing with a roller having a matte surface is used to form the textured surface. In another preferred embodiment of the invention, a convective cell is used to form the textured surface.

An advantage of using a textured surface to produce the separation between the dye-donor and dye-receiver is its simplicity and predictability in using only one uniform composition in the layer. Embossing gives a control over the details of the texture which can be achieved by physical means, and can be kept constant while other details of the formulation change.

The opportunity is available for building into an embossed pattern a particular degree of order, disorder, spatial frequency, peak shape or other topological parameter in a predictable manner. Thus, the scope of variation in the surface texture is larger than can be obtained with using beads.

Patterns formed by surface deformation of thin coatings caused by evaporative convection are described by Anand, J. N. and Karem, H. J. in J. Colloid Interface Science, 31, 203 (1969). Such patterns may be described as "convective cells". A convective cell pattern is formed in a thin polymer coating through the control of the solution concentration/viscosity, flow rate, and other coating process parameters. During coating, evaporative cooling of the coated thin polymer layer results in local temperature gradients which cause local density and surface tension gradients. These forces result in convective flow, causing the formation of a cell or textured pattern upon complete drying. These mechanisms are well understood and are also described by Krishnamurti, R., J. Fluid Mech 33, 445 (1968).

These convective cell surfaces may be used in conjunction with either the dye-receiver or dye-donor. The preferred location is within the dye-receiver. If used in the dye-donor, a single layer of imaging dye, infrared absorbing dye and binder is used to form the convective cell, or the convective cell could be formed in an overcoat layer.

If used as part of the dye-receiver, the convective cells are conveniently coated on a paper or flexible polymeric support with or without opacifying pigment using extrusion hopper techniques as are described in U.S. Pat. No. 2,681,294.

A variety of polymers may be used to form convective cells. Virtually any polymeric overcoat material or dye-receiver polymer that will accept dye and can be solvent coated may be considered practical. Such polymers include cellulose esters, polycarbonates, polyurethanes, polyesters, polyvinylchloride, polyacrylonitrile, or polystyrene either alone, in mixtures, or as a copolymer component.

To obtain the laser-induced thermal dye transfer image employed in the invention, a diode laser is preferably employed since it offers substantial advantages in terms of its small size, low cost, stability, reliability, ruggedness, and ease of modulation. In practice, before any laser can be used to heat a dye-donor element, the element must contain an infrared-absorbing material, such as carbon black, cyanine infrared absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552 and 4,912,083 and U.S. application Ser. Nos.: 366,952, 369,493, 369,492, and 369,491, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing material may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in copending U.S. application Ser. No. 451,656 of Baek and DeBoer, filed Dec. 18, 1989, the disclosure of which is hereby incorporated by reference.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

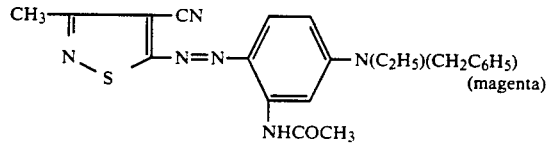

(magenta)

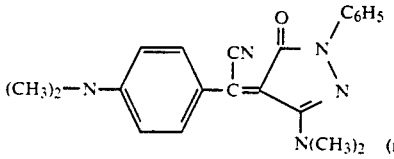

(magenta)

-continued

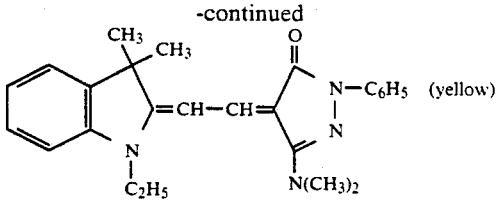

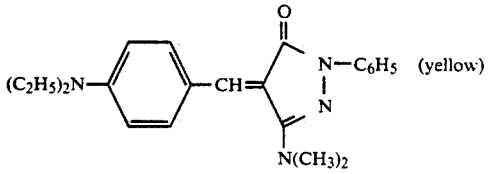

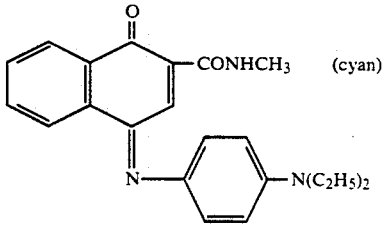

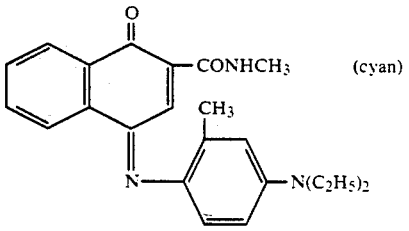

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye in the dye-donor employed in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye-receiving element that is used with the dye-donor element employed in the invention comprises a support having thereon a dye image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, a transparent film support is employed.

The dye image-receiving layer may comprise, for example, a polycarbonate, a polyurethane, a polyester, polyvinyl chloride, poly(styrene-coacrylonitrile), poly(caprolactone) or mixtures thereof. The dye image-receiving layer may be present in any amount which is effective for the intended purpose. In general, good results have been obtained at a concentration of from about 1 to about 5 g/m$^2$.

A process of forming a laser-induced thermal dye transfer image according to the invention comprises:

a) contacting at least one dye-donor element comprising a support having thereon a dye layer comprising a dye dispersed in a polymeric binder having an infrared-absorbing material associated therewith, with a dye-receiving element comprising a support having thereon a polymeric dye image-receiving layer;

b) imagewise-heating the dye-donor element by means of a laser; and c) transferring a dye image to the dye-receiving element to form the laser-induced thermal dye transfer image, and wherein the outer polymeric layer of either the dye-donor element or said dye-receiving element in face-to-face relationship therewith has a textured surface which is formed only by the polymer as described above.

The following examples are provided to illustrate the invention.

EXAMPLE 1

Convective Cell

Dye-receivers were prepared as follows by coating cellulose acetate (40% acetylation, 11 poise viscosity) on a 100 μm thick unsubbed and unpigmented poly(ethylene terephthalate) support from an acetone/dichloromethane solvent mixture. To vary the cell height of the convective cell, the viscosity of the solution coated and coating rate were varied so as to adjust the wet thickness. Specifically the viscosity was either 10.5 cP or 24.2 cP and the wet thickness produced was from 70 to 120 μm, with a web speed of 1370 cm/min. The drying temperature was 27° C. for the first 7.6 m after coating.

A control coating of smooth cellulose acetate was also prepared by lowering the flow rate of the solution to be coated from 90 cc/m$^2$ to 53 cc/m$^2$ and applying a slight vacuum 50 mm water to the hopper. The surface roughness average, $R_a$ in μm (arithmetic average of all the height deviations from the mean surface position) (proportional to the cell height) of each coating was evaluated by determining the average surface roughness (see ANSI B46.1).

For evaluation of laser thermal printing performance, yellow and cyan dye-donors were prepared. Because sticking has been found to vary with the thickness of the donor element, a yellow dye-donor was prepared to represent a "thin" donor and a cyan dye-donor was prepared to represent a "thick" donor.

Individual yellow dye-donor elements were prepared by coating the following layer on a 100 μm unsubbed poly(ethylene terephthalate) support: a layer containing the yellow image dyes illustrated above (each at 0.23 g/m$^2$) and infrared absorbing dye illustrated below (0.10 g.m$^2$) in a cellulose acetate propionate binder (2.5% acetyl, 46% propionyl) (0.23 g/m$^2$) coated from a dichloromethane and 1,1,2 trichloroethylene solvent mixture.

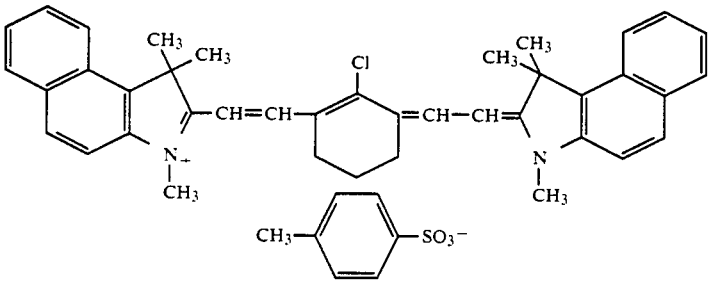

Cyanine Infrared Absorbing Dye

Individual cyan dye-donor elements were prepared by coating the following layer on a 100 μm unsubbed poly(ethylene terephthalate) support: a layer containing the cyan image dyes illustrated above (each at 0.39 g/m$^2$) and infrared absorbing dye illustrated above (0.12 g/m$^2$) in a cellulose acetate propionate binder (2.5% acetyl, 46% propionyl) (0.39 g/m$^2$) coated from a dichloromethane and 1,1,2-trichloroethane solvent mixture.

Single color images were printed as described below from the dye donor sheet onto the integral receiver-frame using a laser imaging device similar to the one described in U.S. Ser. No. 457,595. The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a focusing lens which focused the beam onto a flat platen equipped with vacuum groves. The platen was attached to a moveable stage whose position was controlled by a lead screw which determined the y-axis position of the image. The receiver-frame was held tightly to the platen by means of the vacuum groves, and the dye-donor element was held tightly to the receiver frame by a second vacuum groove.

The wavelength of the laser beam was 830 nm with a power output of 37 mWatts at the platen. The measured spot size of the laser beam was an oval 7 by 9 microns (with the long dimension in the direction of the laser beam sweep). The center-to-center line distance was 10 microns (2540 lines per inch) with a laser scanning speed of 15 Hz. The test image consisted of 10 mm wide steps of 5 different magenta dye densities; the current to the laser was modulated from full power to 16% power in 21% increments.

The imaging electronics were activated and the modulated laser beam scanned the dye-donor to transfer dye to the receiver. After imaging, the exposing device was stopped and the receiver was separated from the dye-donor. The degree of sticking was evaluated as follows, particularly as it was observed in the more critical higher density regions.

Severe—Sticking observed over extensive areas

Marginal—Random sticking observed over scattered small areas

None—No or virtually no sticking observed.

The following results were obtained:

| | STICKING OBSERVED | |
|---|---|---|
| Receiver, Ra (μm) | Yellow Donor | Cyan Donor |
| 0.06 (control)* | Severe | Severe |
| 0.32 (comparison) | Severe | Severe |
| 0.41 (comparison) | Severe | Severe |
| 0.53 (comparison) | Marginal | Severe |
| 0.55 (comparison) | Severe | Severe |
| 0.75 (comparison) | Marginal | Severe |
| 0.80 (invention) | None | Marginal |
| 1.03 (invention) | None | Marginal |
| 1.15 (invention) | None | None |

*This coating may be considered to represent a "smooth" non-convective cell layer of cellulose acetate.

The above data show that a convective cell formed on the receiver with a surface roughness, Ra, of approximately 0.8 μm or more minimized donor to receiver sticking.

EXAMPLE 2

Embossed Surface

Dye receivers were prepared by coating on a transparent 100 μm poly(ethylene terephthalate) support a proprietary glycol-based powder coatable polyester, Rucote® 107, (Ruco Polymer Co.), 6.5 g/m$^2$) and 510 Silicone Fluid® (Dow Corning Co.) (0.016 g/m$^2$) from butanone.

The dye-receiver was then embossed using a Thermacolor® Print Fuser Model SV-65 (Eastman Kodak Co.) which contained a pair of power-driven heated rollers in contact with each other. One roller was coated with matte silicone rubber (A side) while the other roller had a rough metal surface coated with poly(tetra-fluoroethylene) (B side). Sheets of the dye-receiver were placed receiver layer side up against a 150 μm thick sheet of writing paper and transported through the roller set at 3.6 cm/sec at approximately 96° C. either with the dye-receiver facing the A side or B side roller to produce an embossed pattern on the surface of the dye-receiver.

The surface roughness average, $R_a$ in μm (arithmetic average of all the height deviations from the mean surface position) (proportional to the cell height) of each coating was evaluated by determining the average surface roughness (see ANSI B46.1).

A cyan dye-donor element was prepared by coating the following layer on a 100 μm unsubbed poly(ethylene terephthalate) support: a layer containing the cyan image dyes illustrated above (each at 0.23 g/m$^2$), infrared absorbing dye illustrated above (0.05 g/m$^2$), and 510 Silicone Fluid ® (Dow Corning Co.) (0.01 g/m$^2$) in a cellulose acetate propionate binder (2.5% acetyl, 46% propionyl) (0.15 g/m$^2$) coated from a butanone, cyclohexanone and dimethylformamide solvent mixture.

The above-prepared cyan dye-donor was used to prepare images using the procedure of Example 1. After imaging, the exposing device was stopped and the receiver was separated from the dye-donor. The Status A Red transmission density was read as follows:

| | | STATUS A RED DENSITY | | | |
|---|---|---|---|---|---|
| Receiver | $R_a$ (μm) | Step 2 | Step 5 | Step 8 | Step 12 |
| Non-embossed (Control) | 0.5 | 3.1 | 3.4 | 3.0 | 3.2 |
| Embossed (Side A) | 1.3 | 0.4 | 1.2 | 1.5 | 1.4 |
| Embossed (Side B) | 2.3 | 0.1 | 0.9 | 2.1 | 2.4 |

The above results show that the receiver without the embossed surface showed very little gradation in density throughout the scale (step 2=low exposure, to step 12=maximum exposure and density). The receiver according to the invention that had an embossed surface having an $R_a$ of at least 0.8 μm gave a good tonal scale or variance of density.

The invention has been described in detail with particular reference to preferred embodiments thereof, but it will be understood that variations and modifications can be effected within the spirit and scope of the invention.

What is claimed is:

1. A thermal dye transfer assemblage comprising:

a) a dye-donor element comprising a support having thereon a dye layer comprising a dye dispersed in a polymeric binder and an infrared absorbing material contained in said dye layer or in a separate layer associated therewith, and b) a dye-receiving element comprising a support having thereon a polymeric dye image-receiving layer, said dye-receiving element being in a superposed relationship with said dye-donor element so that said dye layer is adjacent to said dye image-receiving layer, the improvement wherein said polymeric layer of either said dye-donor element or said dye-receiving element in face-to-face relationship therewith has a textured surface which is formed only by said polymer, so that effective contact between said dye-receiving element and said dye-donor element is prevented during transfer of a laser-induced thermal dye transfer image, said textured surface having a surface roughness average, $R_a$, of at least 0.8 μm.

2. The assemblage of claim 1 wherein said textured surface is a convective cell.

3. The assemblage of claim 2 wherein said convective cell is on the outer surface of said receiving element.

4. The assemblage of claim 1 wherein said textured surface is obtained by embossing with a roller having a matte surface.

5. The assemblage of claim 1 wherein said infrared-absorbing material is an infrared-absorbing dye.

6. The assemblage of claim 1 wherein said support for said dye-receiving element is a transparent film.

7. In a process of forming a laser-induced thermal dye transfer image comprising:

a) contacting at least one dye-donor element comprising a support having thereon a dye layer comprising a dye dispersed in a polymeric binder having an infrared-absorbing material contained in said dye layer or in a separate layer associated therewith, with a dye-receiving element comprising a support having thereon a polymeric dye image-receiving layer;

b) imagewise-heating said dye-donor element by means of a laser; and c) transferring a dye image to said dye-receiving element to form said laser-induced thermal dye transfer image, the improvement wherein said polymeric layer of either said dye-donor element or said dye-receiving element in face-to-face relationship therewith has a textured surface which is formed only by said polymer, so that effective contact between said dye-receiving element and said dye-donor element is prevented during transfer of said laser-induced thermal dye transfer image, said textured surface having a surface roughness average, $R_a$, of at least 0.8 μm.

8. The process of claim 7 wherein said textured surface is a convective cell.

9. The process of claim 8 wherein said convective cell is on the outer surface of said receiving element.

10. The process of claim 7 wherein said textured surface is obtained by embossing with a roller having a matte surface.

11. The process of claim 7 wherein said infrared-absorbing material is an infrared-absorbing dye.

12. The process of claim 7 wherein said support for said dye-receiving element is a transparent film.

* * * * *